United States Patent [19]

Greene et al.

[11] 4,183,596

[45] Jan. 15, 1980

[54] TWO WAY TRAVEL DRAWER SLIDE

[75] Inventors: Roger F. Greene; Gordon F. Clark, both of Lake City, Iowa

[73] Assignee: Bowie Mfg. Co., Lake City, Iowa

[21] Appl. No.: 4,273

[22] Filed: Jan. 17, 1979

[51] Int. Cl.[2] ..... A47B 88/00

[52] U.S. Cl. ..... 312/333; 312/348; 312/286; 312/334; 308/3.8

[58] Field of Search ..... 312/333, 334, 348, 341 R, 312/286, 338, 283; 308/3.8; 108/69; 211/1.3

[56] References Cited

U.S. PATENT DOCUMENTS

| | | | |
|---|---|---|---|
| 1,736,108 | 11/1929 | Anderson et al. | 312/286 |
| 2,565,784 | 8/1951 | Sheean | 312/286 |
| 2,599,865 | 6/1952 | Rudman | 312/333 |
| 2,614,022 | 10/1952 | Kurtzon | 312/348 |
| 2,914,370 | 11/1959 | Hensch et al. | 312/286 |
| 3,050,348 | 8/1962 | Pipe | 308/3.8 |
| 3,782,800 | 1/1974 | Remington et al. | 312/348 |
| 3,937,531 | 2/1976 | Hagen et al. | 308/3.8 |
| 3,975,063 | 8/1976 | Mahotka et al. | 312/341 R |
| 4,065,196 | 12/1977 | Stein | 312/333 |

*Primary Examiner*—Victor N. Sakran
*Attorney, Agent, or Firm*—Morton S. Adler

[57] ABSTRACT

A two way travel three section drawer slide assembly is provided for cabinets, desks, files, service vehicles and the like to permit a drawer to be selectively extended from opposite sides. The assembly includes an outer channel section for attachment to a support body such as a cabinet wall, a central channel section slidably mounted within the outer section and an interior channel section slidably mounted to the central section and fixedly attached to the drawer to be moved. The present invention particularly provides improved movable stops wholly within the confines of the assembly to facilitate and assure the proper movement of the central section to full extension and full retraction whereby no latching or locking devices exteriorly of the slide assembly are required. Latch members on opposite sides of the drawer and support body prevent accidental outward movement of the drawer. This invention is also usable on drawer assemblies having more than three sections.

10 Claims, 11 Drawing Figures

TWO WAY TRAVEL DRAWER SLIDE

BACKGROUND OF THE INVENTION

This invention relates to improvements in drawer slides of the type which permit a drawer to be selectively pulled out from opposite sides of a support body such as a desk, file cabinet, service vehicle and the like.

Two way or double pull drawers of various types have been known and used for some time and may be classified generally as being two member or three member assemblies. The two member assembly has one member fixed to the frame or support body for the drawer such as a desk or cabinet and a movable member attached to the drawer and to the fixed member. With this arrangement, the drawer cannot be held regidly when the mounting point connecting it to the slide is moved more than one half the length of the drawer and thus there is the inherent disadvantage that only approximately one half of the drawer space is accessible from either side of the support body. Examples of two member slides appear in U.S. Pat. Nos. 2,565,784 and 2,599,865.

The three member assembly, as is well known, permits extension of the drawer to nearly one hundred percent of its length and the present invention is directed to improvements in this type of slide assembly. The three member assembly also uses one member fixed to the support body and a movable member attached to the drawer but includes a third member slidably arranged intermediate and operably connected to both of the other two members. Examples of the three member slide assembly are disclosed in U.S. Pat. Nos. 1,736,108 and 2,914,370.

Notwithstanding the advantage of the three member slide in permitting substantially one hundred percent extension of the drawer, it has been our observation that malfunction of the slide capability of the intermediate third member is commonly experienced with the result that the drawer frequently cannot be fully retracted. Such malfunctioning is found to exist in various latching and locking arrangements generally found mounted within the support body but exteriorly of the slide assembly itself so as to require considerable adjustment and alignment.

With the above observations in mind, one of the important objects of the present invention is to provide an improved and trouble free operating three member two way travel drawer supporting slide assembly.

More particularly, it is an object herein to provide a drawer slide assembly of the above class that consists generally of an outer elongated channel section for fixed attachment to a support body, a central channel section slidably mounted within the channel of the outer section and an interior section slidably mounted within the channel of the center section and fixedly attached to a drawer to be moved into and out of a support body together with an improved arrangement of movable stops designed to facilitate and assure the proper movement of the central section relative to the outer and interior sections to permit substantially full extension and trouble free retraction of the drawer relative to respective opposite sides of the support body.

Another object herein is to provide a drawer slide assembly as characterized in which all components operable to effect or control the sliding movement of the several sections and particularly the central section are arranged within the confines of the overall assembly and no control elements attached to the support body for such purposes are required.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENT

Figure 1:
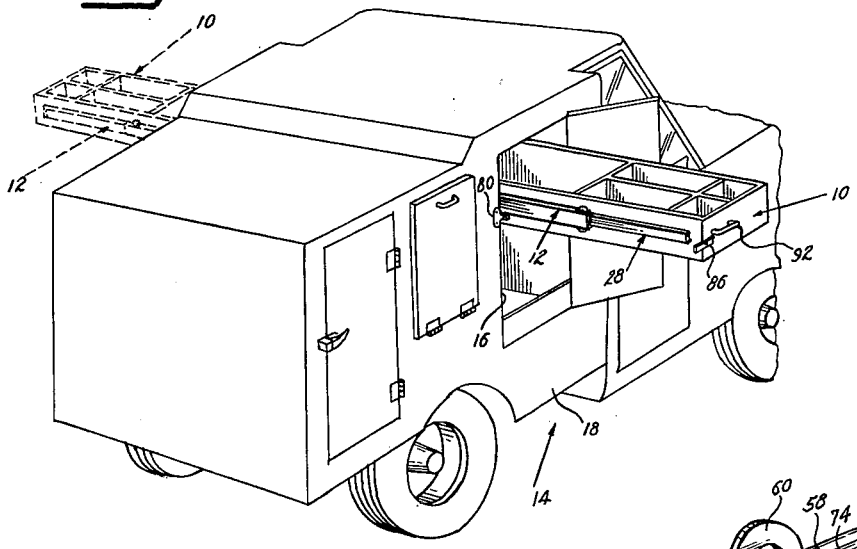
FIG. 1 is a perspective view of a service vehicle having a body portion in which this invention is shown mounted and indicating the two way operation thereof.

Referring to the drawings, an example of a two way or double pull drawer 10 mounted on our slide assembly designated generally by the numeral 12, is illustrated in FIG. 1 on a service vehicle 14 provided with a suitable compartment 16 in body 18 to support assembly 12 and contain drawer 10. It is not intended that slide assembly 12 be limited to use shown in a service vehicle 14 since it may be utilized in other environments adapted for double pull drawers such as desks, file cabinets and the like as is well known.

Slide assembly 12 (FIGS. 2–4) is a three section two way slidable unit which, in general, comprises an outer elongated section 20 adapted to be fixedly attached to one wall of compartment 16 in any suitable manner such as by screws 22 through appropriately placed holes 24, a central or intermediate section 26 which is slidably journalled in section 20 and an inner or interior section 28 slidably journalled in section 26 and adapted to be fixedly secured to one side of drawer 10 in any suitable manner such as by fasteners 30 through appropriately spaced holes 32, it being noted that identical assemblies 12 are mounted relative to opposite sides of compartment 16 and drawer 10 so that a description of only one assembly 12 will suffice for present purposes. No invention is claimed for the three member assembly per se comprising sections 20, 26 and 28 as shown but invention is claimed for the improvement movement control means particularly for the intermediate or central section 26 as will be referred to in detail as this description proceeds.

Figures 4, 5, 6, 7, 8, 9, 10:
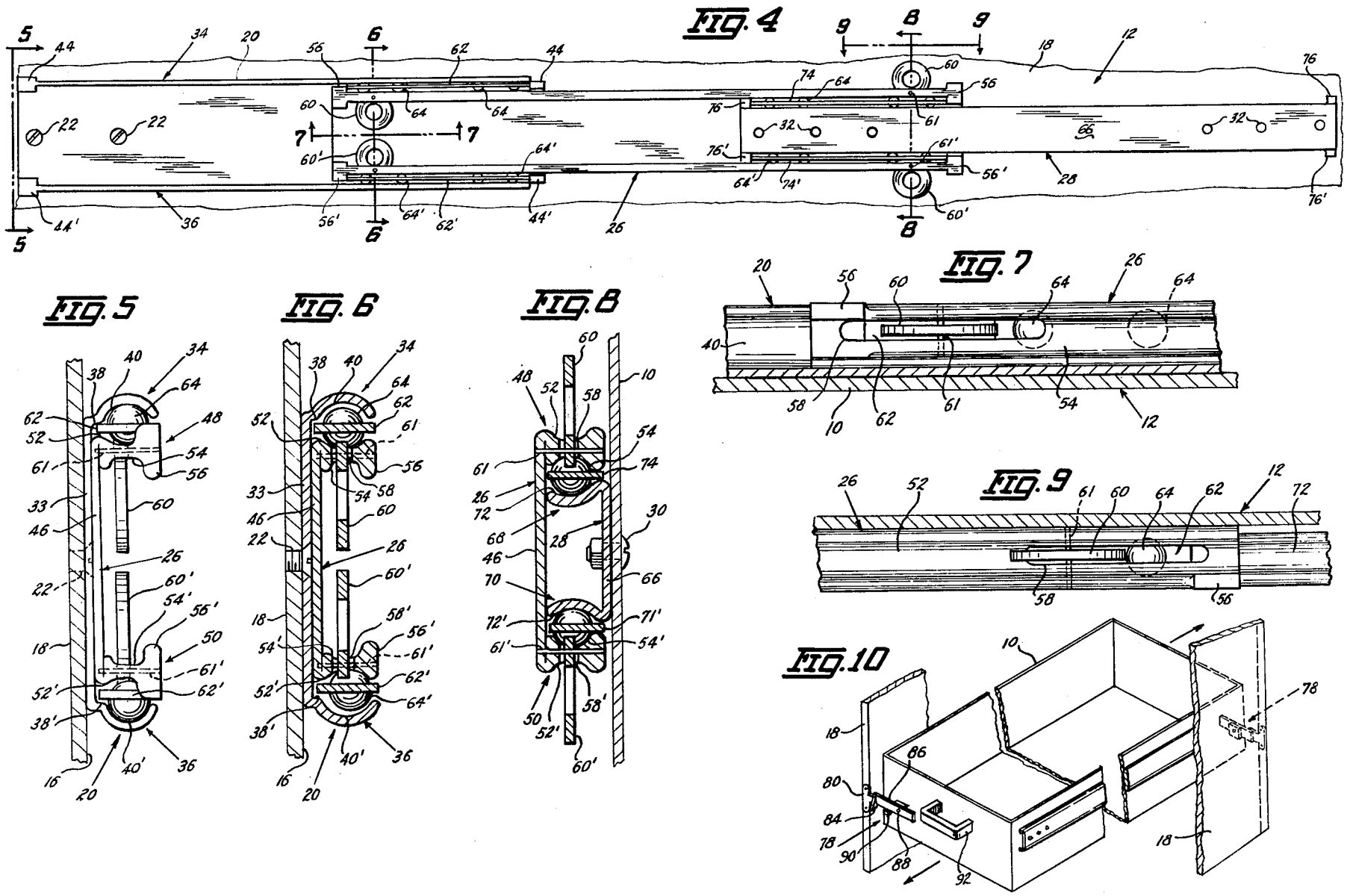
FIG. 4 is a side elevational view of this slide assembly shown extended in one direction.
FIG. 5 is an end view taken from the line 5—5 of FIG. 4.
FIG. 6 is a sectional view taken on the line 6—6 of FIG. 4.
FIG. 7 is a plan view taken from the line 7—7 of FIG. 4.
FIG. 8 is a sectional view taken on the line 8—8 of FIG. 4.
FIG. 9 is a plan view taken from the line 9—9 of FIG. 4.
FIG. 10 is a perspective view of a drawer showing latch means at each end relative to the support body.

With reference now more particularly to FIGS. 1,5,6, the outer section 20 is a channel bar having the bar member 33 with the respective opposed upper 34 and lower 36 channels. Bar portion 33 is attached to the wall of compartment 16 in body 18 so that channels 34, 36 project into the compartment. Channels 34, 36 are of like formation so, primarily, channel 34 will be described in detail and like parts on channel 36 will be given like numerals primed.

Channel 34 extends first perpendicularly from the top edge of bar 33 away from wall 16 to form a flat track surface 38 and then upwardly into a half circle shape to form the curved or grooved track 40 and it will be understood that on the lower channel 36, track 40' extends downwardly from track 38'. The length of channels 34, 36 is slightly less than the length of bar 33 so that bar 33 projects beyond such channels at both ends, indicated at 42 in FIG. 2, and at the upper and lower ends of projection 42 at each end of bar 33, are the respective stops 44, 44' which extend across and define the terminal points of the flat track 38, 38'.

Figure 2:
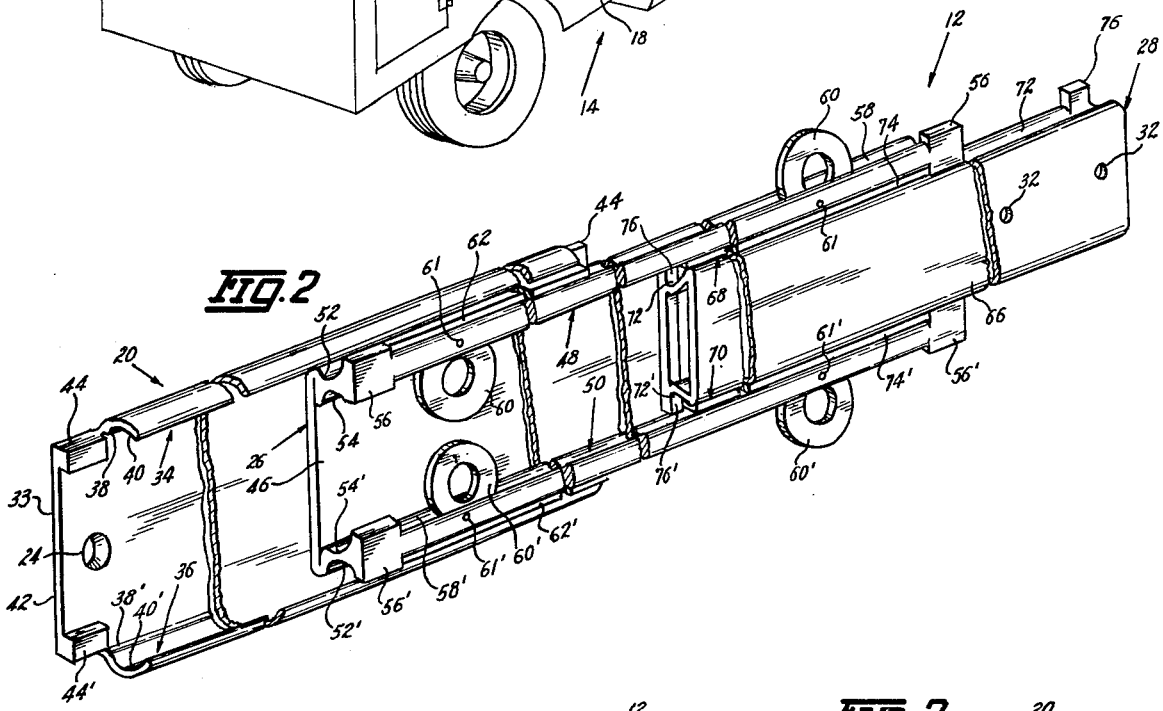
FIG. 2 is an enlarged foreshortened perspective view of this slide assembly from the interior side shown extended in one direction.

The central section 26 is also a channel bar slidably within the outer section 20 as best seen in FIG. 2 and includes the bar member 46 disposed in juxtaposition to bar member 33, and the respective like upper 48 and lower 50 channels so that, primarily, channel 48 will be described in detail and like parts on channel 50 will be given like numerals primed. The top edge of channel 48 is provided with the grooved track 52 with the corresponding track 52' on channel 50 being the bottom edge thereof as seen in FIG. 2 and in juxtaposition to the tracks 52, 52' on the inner sides of channels 48, 50 are the respective grooved tracks 54, 54'. Thus far described and as seen in FIGS. 5,6, the respective tracks 40, 40' on the outer section 20 complement the tracks 52, 52' on the center section 26 to provide a trackway for other components yet to be described. At each end of channels 48, 50 are the respective stops 56, 56' which define the terminal point of the respective tracks 52, 54 and 42', 54'. The construction of channel sections 20, 26 as thus far described are well known in slide assembly devices and it is to such type of device we have made important improvements as follows.

At each end portion of channels 48, 50 we have provided respective slots 58, 58' which communicate with the respective tracks 52, 54 and 52', 54' as seen in FIG. 2. In each slot 58, 58', a disk-like dog 60, 60' is pivotally and eccentrically mounted, 61, 61', so that opposed dogs can move towards each other through slots 58, 58' and track 52, 52' and away from each other through slots 58, 58' and track 54, 54' as shown in FIG. 2. It is noted that while dogs 60, 60' are shown as round washer type disks, other shapes such as oval, square, triangular and the like capable of movement as described may be used without any departure from the principles involved. In each of the trackways provided by the complementary tracks 40, 52 and 40', 52', there is disposed the elongated bar stop 62, 62' which is slidable therein by means of the ball bearings 64 disposed in longitudinal spaced relationship in appropriate holes in stops 62, 62', such ball bearings being confined by the curved tracks 40, 52 and 40', 52'. Thus arranged, one longitudinal edge of stop bars 62, 62' is disposed to move in track 38, 38' as seen in FIGS. 5,6 and is a well known arrangement in the conventional construction of the three member slide assembly.

The inner section 28 (FIGS.2,8) is also of known construction and includes the bar member 66 for attachment to drawer 10 as described and the respective like upper 68 and lower 70 channels for which channel 68 will be primarily described and like parts on channel 70 will be given like numerals primed. The top edge of channel 68 and corresponding edge of channel 70 are formed with the respective grooved tracks 72, 72' and with section 28 slidably journalled in section 26 as seen in FIG. 2, track 72 complements track 54 on section 26 to form a trackway in which is mounted a ball bearing stop bar 74 similar to bar 62. Likewise, track 72' on section 28 complements track 54' on section 26 to form a trackway for stop bar 74' as shown. Each end of channels 68, 70 are provided with the respective stops 76, 76'.

OPERATION

Figure 3:
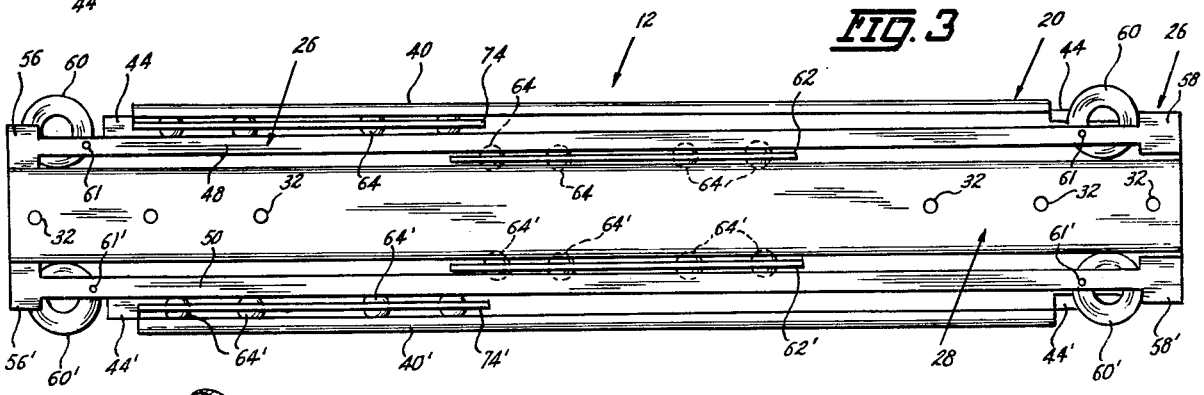
FIG. 3 is a side elevational view of this invention from the interior side shown in closed or retracted position.

The closed or retracted position of slide assembly 12 is seen in FIG. 3 where the position of section 28, attached to drawer 10, positions the dogs 60, 60' through slots 58, 58' generally in the outer rolled tracks 52, 52' of channels 48, 50 of the intermediate section 26. In this position, section 26 cannot be moved in either direction because of the stop engagement capability of dogs 60, 60' with the end of the rolled edges on tracks 40, 40' of section 20.

In the opening of drawer 10, being shown in the drawings from left to right, section 28 first moves with the drawer 10 so that the left end of section 28 slides away from the left end of section 26 to no longer support dogs 60, 60' in the position shown in FIG. 3 and such dogs are free to move through slots 58, 58' to the interior portion of section 26. As drawer 10 and section 28 are pulled further out, stop bars 62, 62' will move dogs 60, 60' at the right end of section 26 to th position shown in FIGS. 2,4 and also contact stops 56, 56' on section 26 at the right end thereof whereby section 26 is also moved from left to right. As this occurs, dogs 60, 60' at the left end of section 26 engage the edges of channels 40, 40' and are moved through slots 58, 58' into the interior of section 26 as also seen in FIGS. 2,4. Further movement of the assembly to the right to substantially the full amount of drawer 10 terminates when stop bars 74, 74' engage stops 44, 44' at the right end of section 20.

In closing drawer 10, being from right to left as shown, section 28 slides relative to section 26 until the left end of section 28 engages the dogs 60, 60' at the left end of section 26 which, being confined by the rolled channels 40, 40' cannot move at that point through slots 58, 58' and thus serve as temporary stops so that continued pushing inwardly of drawer 10 and section 28 effects the sliding of section 26 from right to left back to closed position and as the left end of section 26 clears the left end of channels 40, 40' on section 20, the continued movement of section 28 pushes the dogs 60, 60' through slots 58, 58' to the position shown in FIG. 3. The opening of drawer 10 to the left is a mirrored action of the sequence just described. In the above arrangement, it is noted particularly that the several dog components are completely contained within the confines of the three member assembly and eliminates the need usually found in other assemblies of this class for additional mountings on the body member in which the drawer is arranged and the inherent problems in correcting and aligning a plurality of separate mechanisms to assure operability particularly of the intermediate section of a three member slide assembly.

Figure 11:
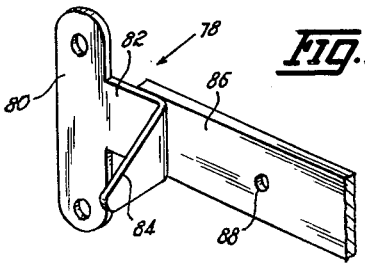
FIG. 11 is an enlarged perspective view of the complementary latch components for the support body and the drawer.

Reference is now made to FIGS. 10, 11 relative to a simple latch means 78 which we have applied to opposite ends of drawer 10 as best seen in FIG. 10 even though for many purposes in stationary bodies such as desks and cabinets, a latch means such as 78 may not normally be required to prevent any accidental opening of the drawer 10. However, notwithstanding the described control means relative to movement of section 26, it will be appreciated that section 28 attached to drawer 10 is free to move in either direction and since assembly 12 as shown and described has been adapted on a service vehicle 14, latch means 78 prevents any accidental opening of drawer 10 when such vehicle may be in motion.

Latch 78 includes a strike plate 80 attached to the outer side of body 18 adjacent compartment 16 and projects slightly into compartment 16 as at 82 but not far enough to interfere with the free movement of drawer 10 out of and into such compartment.

Integral with portion 82 is the cam-like edge 84 extending outwardly from body 18. A normally horizontal bar 86 is pivotally secured, 88, intermediate its ends to the end of drawer 10 and its horizontal position is maintained by stop 90 on the drawer in which position, one end of bar 86 rests behind and engages strike plate portion 82 so that drawer 10 cannot be pulled out. A drawer pull or handle 92 on drawer 10 is convenient to the other end of bar 86 so that such bar can be easily pivoted out of engagement with member 82 when the pull is grasped. When drawer 10 is moved to closed position, bar 86 will automatically pivot upon contact with the cam surface 84 and return to latched position. Latch 78 as described is provided on each end of drawer 10 and the respective latches are independent of each other for their intended purpose.

The present invention has been described preferably in relation to commonly used three section slide assemblies. However, more than three sections are sometimes used having a plurality of like central sections referred to and the present invention can be adapted to such multiple sections without departing from the principles disclosed.

Accordingly, in view of the foregoing, it is thought a full understanding of the construction and operation of this invention will be had and the advantages of the same will be appreciated.

We claim:

1. A two way travel three section drawer slide assembly for permitting a drawer to be selectively pulled out from opposite sides of a support body, comprising in combination:

an outer elongated channel section fixedly attached to the support body, a central elongated channel slide section telescopically slidably journalled in said outer section for movement in two respective opposite directions, an inner elongated slide section telescopically slidably journalled in said central section for movement in two respective opposite directions and adapted for attachment to a drawer to be moved, respective complementary stop means on said central and inner sections operable to effect and limit the relative movement thereof in extension within predetermined limits, respective movable stop members at respective end portions of said central section capable of movement to and from a position within the confines of said central section, said inner section in retracted position acting against said stop members to move them out of the confines of said central section, the extension of said inner section outwardly from said central section in a selected direction and the resulting movement of the trailing end thereof relative to the direction of movement effecting the disengagement of said trailing end with the corresponding stop members on said central section, the continued movement of said inner section in said selected direction acting to engage said stop means to effect corresponding movement of said central section, means on said outer section operable during the extension of said central section to move said stop members into the confines of said central section and hold them immovable therein, said inner section when moved in the opposite direction towards retracted position acting against said immovable stop members to effect the retraction of said central section, and full retraction of said inner section acting in cooperation with said outer section to restore mobility to said stop members and to move them out of the confines of said central section.

2. A drawer slide assembly as defined in claim 1, including:

a drawer closed at opposed ends and attached to said inner section for movement therewith, a first respective latch component on respective opposite sides of the support body, a second respective latch component on respective opposite ends of said drawer, and said respective second latch components being independently releasably engageable with a respective corresponding first latch component.

3. A drawer slide assembly as defined in claim 1, including:

said stop members when out of the confines of said central section being engageable with respective ends of said outer section, and said inner section when fully retracted acting against stop members to maintain them in engagement with said outer section so that said central section is locked against movement relative thereto.

4. A two way travel drawer slide assembly for permitting a drawer to be selectively pulled out from opposite sides of a support body, comprising in combination:

an outer elongated channel section fixedly attached to the support body, a central elongated channel slide section telescopically slidably journalled in said outer section for movement in two respective opposite directions, an inner elongated slide section telescopically slidably journalled in said central section for movement in two respective opposite directions and adapted for attachment to a drawer to be moved, respective complementary stop means on said central and inner sections operable to effect and limit the relative movement thereof in extension within predetermined limits, respective dogs pivotally secured at respective end portions of said central section so as to be capable of movement to an interior position within the confines of said central section and to an exterior position exteriorly of said central section, the respective end portions of said inner section in retracted position within said central section acting against said dogs to move them to and maintain them in their exterior position, the extension of said inner section outwardly from said central section in a selected direction and the resulting movement of the trailing end thereof relative to the direction of movement effecting the disengagement of said trailing end with the corresponding dogs on said central section, the continued movement of said inner section in said selected direction acting to engage said stop means to effect corresponding movement of said central section whereby said exteriorly positioned dogs are acted upon by said outer section to move said dogs to their interior position during extension of said central section, said dogs in said interior position during extension of said central section being confined by said outer section and restricted in movement to said exterior position so as to serve as temporary stops, said inner section when moved in the opposite direction towards retracted position acting against said interiorly positioned dogs to effect the retraction of said central section during which movement said dogs are moved clear of confinement from said outer section, and full retraction of said inner section acts on said dogs to move them to their exterior position.

5. A drawer slide assembly as defined in claim 4, including:

said dogs when in said exterior position being engageable with respective ends of said outer section, and said inner section when fully retracted acting against said dogs to maintain them in engagement with said outer section so that said central section is locked against movement relative thereto.

6. A drawer slide assembly as defined in claim 4, including:

a drawer closed at opposed ends and attached to said inner section for movement therewith, a first respective latch component on respective opposite sides of the support body, a second respective latch component on respective opposite ends of said drawer, and said respective second latch components being independently releasably engageable with a respective corresponding first latch component.

7. A two way travel drawer slide assembly for permitting a drawer to be selectively pulled out from opposite sides of a support body, comprising in combination:

an outer elongated channel-edged section fixedly attached to the support body, a central elongated channel-edged slide section telescopically slidably journalled in said outer section for movement in two respective opposite directions, an inner elongated slide section telescopically slidably journalled in said central section for movement in two respective opposite directions and adapted for attachment to a drawer to be moved, respective complementary stop means on said central and inner sections operable to effect and limit the relative movement thereof in extension within predetermined limits, said central and inner sections being of substantially like length and longer than the channel edges on said outer section so that in retracted position, respective opposite end portions of the channel edges on said central section project longitudinally from respective corresponding ends of the channel edges on said outer section, said respective projecting end portions in said channel edges on said central section being provided with an elongated slot, respective dogs pivotally secured in said respective slots so as to be capable of movement through said slots to an interior position within the confines of said central section and to an exterior position projecting exteriorly of said channel edges on said central section, the respective end portions of said inner section in retracted position within said central section acting against said dogs to move them to and maintain them in their exterior position, the extension of said inner section outwardly from said central section in a selected direction and the resulting movement of the trailing end thereof relative to the direction of movement effecting the disengagement of said trailing end with the corresponding dogs on said central section, the continued movement of said inner section in said selected direction acting to engage said stop means to effect corresponding movement of said central section whereby said exteriorly positioned dogs are acted upon by the channel edges of said outer section to move said dogs through said slots to their interior position during extension of said central section, said slots during extension of said central section being enclosed by said channels on said outer section during which time movement of said dogs to exterior position is restricted by said channels and said dogs being immovable serve as temporary stops, said inner section when moved in the opposite direction towards retracted position acting against said interiorly positioned dogs to effect the retraction of said central section during which movement said slots are moved clear of enclosure by the channels on said outer section, and full retraction of said inner section acts on said dogs to move them through said slots to their exterior position.

8. A drawer slide assembly as defined in claim 7, including:

said dogs when in said exterior position being engageable with respective ends of the channel edges on said outer section, and said inner section when fully retracted acting against said dogs to maintain them in engagement with said outer section so that said central section is locked against movement relative thereto.

9. A drawer slide assembly as defined in claim 7, including:

a drawer closed at opposed ends and attached to said inner section for movement therewith, a first respective latch component on respective opposite sides of the support body, a second respective latch component on respective opposite end of said drawer, and said respective second latch components being independently releasably engageable with a respective corresponding first latch component.

10. A two way travel drawer slide assembly for permitting a drawer to be selectively pulled out from opposite sides of a support body, comprising in combination;

first, second and third elongated slide assembly members arranged so that said second member is telescopically slidably journalled in said first member for movement in two respective opposite directions, said third member is similarly journalled in said second member, said first member is adapted for fixed attachment to a support body and said third member is adapted for fixed attachment to a drawer to be moved, respective complementary interacting stop means on said second and third members operable when said third member is moved in a selected direction to effect and limit the relative movement thereof in extension within predetermined limits, movable stop members in said second member, means on said first member to hold said stop members immovable upon extension of said second and third members, said third member when moved in the opposite direction acting against said immovable stop members to effect retraction of said second member and at a predetermined point of said movement said third member acting in cooperation with said first member to restore mobility to said stop members to permit full retraction of said third member within said second member, and said stop members being disposed entirely within the confines of said slide assembly so as to be free of attachment to and interaction with any element exteriorly thereof.

* * * * *